US005090934A

United States Patent [19]

Quercetti

[11] Patent Number: 5,090,934

[45] Date of Patent: Feb. 25, 1992

[54] VEHICLE MODEL WITH TRANSPARENT, SEPARABLE COMPONENTS

[76] Inventor: Alessandro Quercetti, Strada San Vito a Revigliasco 48, I-10133 Turin, Italy

[21] Appl. No.: 660,303

[22] Filed: Feb. 15, 1991

[30] Foreign Application Priority Data

Feb. 21, 1990 [IT] Italy ..... 67121-A/90

[51] Int. Cl.[5] ..... A63H 17/00; A63H 17/26; G09B 25/00

[52] U.S. Cl. ..... 446/93; 446/471; 434/373; 434/370

[58] Field of Search ..... 446/93, 94, 95, 96, 446/85, 236, 237, 238, 431, 448, 465, 468, 470, 471; 434/401, 373, 370

[56] References Cited

U.S. PATENT DOCUMENTS

| | | | |
|---|---|---|---|
| 2,726,482 | 12/1955 | Roehrl et al. | 434/373 X |
| 3,566,536 | 3/1971 | Baynes et al. | 446/465 |
| 3,638,356 | 2/1972 | LaBranche | 446/465 |
| 3,986,278 | 10/1976 | Valentine | 434/373 X |
| 3,991,488 | 11/1976 | Valentine | 434/373 X |
| 4,003,140 | 1/1977 | Valentine | 434/373 X |
| 4,109,398 | 8/1978 | Hida | 434/370 |
| 4,120,118 | 10/1978 | Mathens et al. | 434/373 X |
| 4,615,686 | 10/1986 | Bartos | 446/471 X |
| 4,840,599 | 6/1989* | Ming | 446/463 |

FOREIGN PATENT DOCUMENTS

| | | | |
|---|---|---|---|
| 2909557 | 9/1980 | Fed. Rep. of Germany | 446/468 |
| 495622 | 11/1938 | United Kingdom | 434/470 |
| 1424808 | 2/1976 | United Kingdom | 446/448 |

*Primary Examiner*—David N. Muir
*Attorney, Agent, or Firm*—Young & Thompson

[57] ABSTRACT

An instructive toy consisting in a disassemblable vehicle model, which comprises a supporting structure which substantially simulates the frame of a real vehicle and is provided with releasable connections, and a number of operative units, provided with releasable connections complementary to the releasable connections of the supporting structure, and also provided with operative connections complementary to corresponding operative connections of other units. Each operative unit simulates a main functional unit of a real vehicle, particularly an engine unit, a speed gear unit and a differential unit, and each operative unit comprises movable component parts intended to simulate the operation of the simulated real functional unit, mounted within a transparent casing which allows their observation. The structure and the operation of the different operative units may be observed both separately in the disassembled model, and in their whole in the mounted model.

12 Claims, 6 Drawing Sheets 2
7
7A
8
9
10
11
20
20'
21
22
22'
23
23'
24
25
26
27
28
29

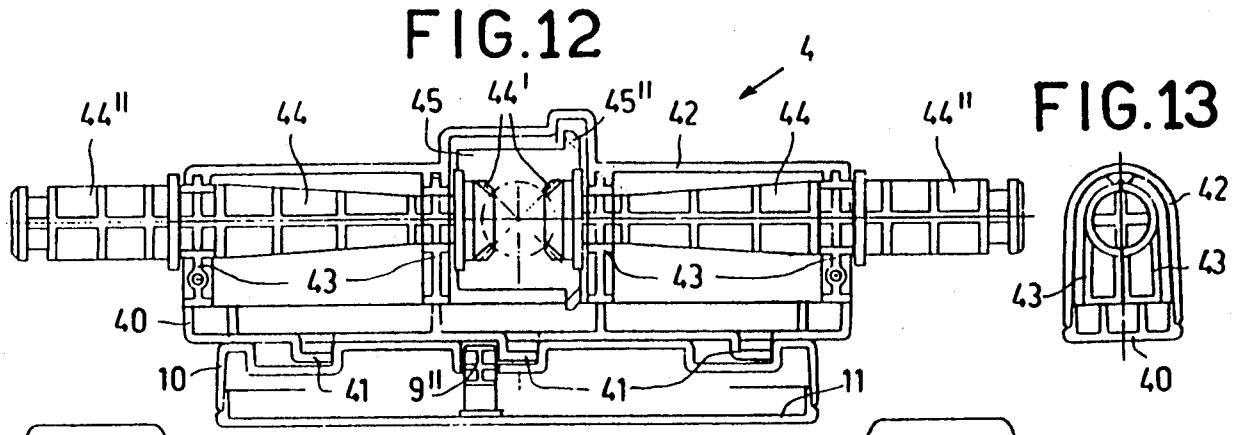
FIG.12
FIG.13
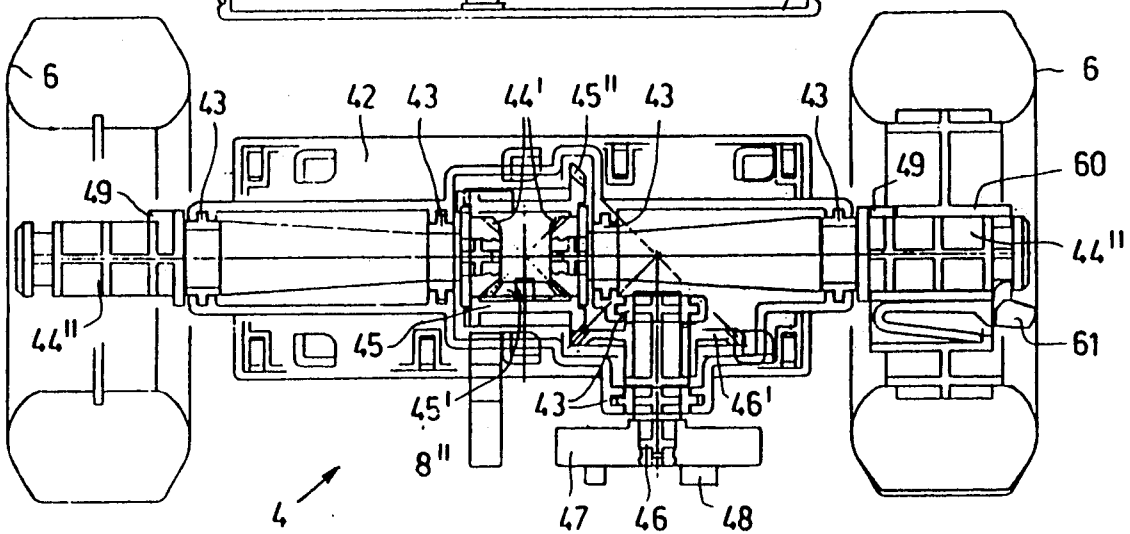
FIG. 11
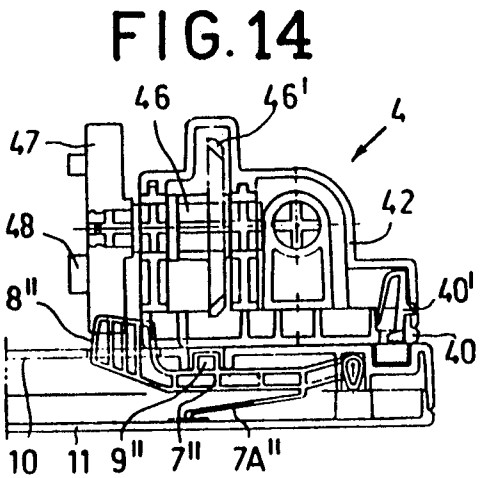
FIG.14

VEHICLE MODEL WITH TRANSPARENT, SEPARABLE COMPONENTS

DESCRIPTION

BACKGROUND OF THE INVENTION

The subject of this invention is an instructive toy consisting in a dissassembleable vehicle model.

There are known some toys which consist in vehicle models susceptible of being disassembled in several functional parts which constitute the models; moreover it is known a toy which represents an internal combustion engine comprising movable parts mounted within a transparent casing which allows observing their movements. These toys have some instructive character in that the first ones evidence the position relationship among the main structural parts of a vehicle, and the second one evidences, for the engine only, the structural and functional relationship among the component parts. However it is not known any instructive toy or didactic aid capable of evidencing both the whole structure and the operation of a vehicle with reference to all its main component parts.

SUMMARY OF THE INVENTION

The object of this invention is to realize an instructive toy, or didactic aid, having the form of a dissassemblable vehicle model, which in its mounted condition allows observing the structure and, in a simulation, the coordinated operation of all the functional units forming the main components of a real vehicle, and which moreover, in its disassembled condition, allows singularly observing the structure and the simulated operation of each functional unit per se.

This object is attained, according to the invention, mainly in that the toy comprises a supporting structure which substantially simulates the frame of a real vehicle and is provided with releasable connection means, and a number of operative units, provided with releasable connection means complementary to the releasable connection means of the supporting structure, and also provided with operative connection means complementary to corresponding operative connection means of other units, each operative unit simulating a main functional unit of a real vehicle, and each operative unit comprising movable component parts intended to simulate the operation of the simulated real functional unit, mounted within a transparent casing which allows their observation.

Thanks to these characteristics, the vehicle model in its mounted condition shows groups of movable component parts which may be observed through their transparent casings, and which simulate the main functional units of a real vehicle, such as the engine, the transmission, the differential and the steering gear, and therefore it allows observing both the relative structural positions of these functional units in a vehicle, and their operative relationship, co-ordinated in the movement. Such a whole observation is suitable and useful even for very young people. Moreover the toy, when used by more mature people, is suitable for being disassembled in the various constituting units, and then each unit may be singularly observed in detail in its structure and operation, whereas the operation for disassembling the model in its constituting units and for mounting it again is, per se, an attractive and formative activity. An increased formative effect may be obtained by subjecting these operations for disassembling and mounting again the model to specific rules, namely by making possible the dismounting and the mounting of the constituting units only by following a pre-established, intransgressible order.

Moreover, each constituting unit may be realized, on its turn, in such a way that it may be dismounted and mounted again, thus making the toy attracting even for considerably more mature people.

BRIEF DESCRIPTION OF THE DRAWINGS

These and other features and advantages of the subject of this invention will appear more clearly from the following description of an embodiment, given as a non limitative example, diagrammatically shown in the appended drawings, in several of whose figures some parts have been omitted, or represented only by their outline, in order to achieve a better clarity of the representation. In the drawings:

FIGS. 11 and 12 show, respectively in plan view and in a side elevation, the unit which simulates the differential of a real vehicle;

FIG. 13 shows a detail of the realization of a bearing supporting an axle-shaft of the differential; and FIG. 14 shows the means for fixing the differential unit onto the supporting structure.

Figure 1:
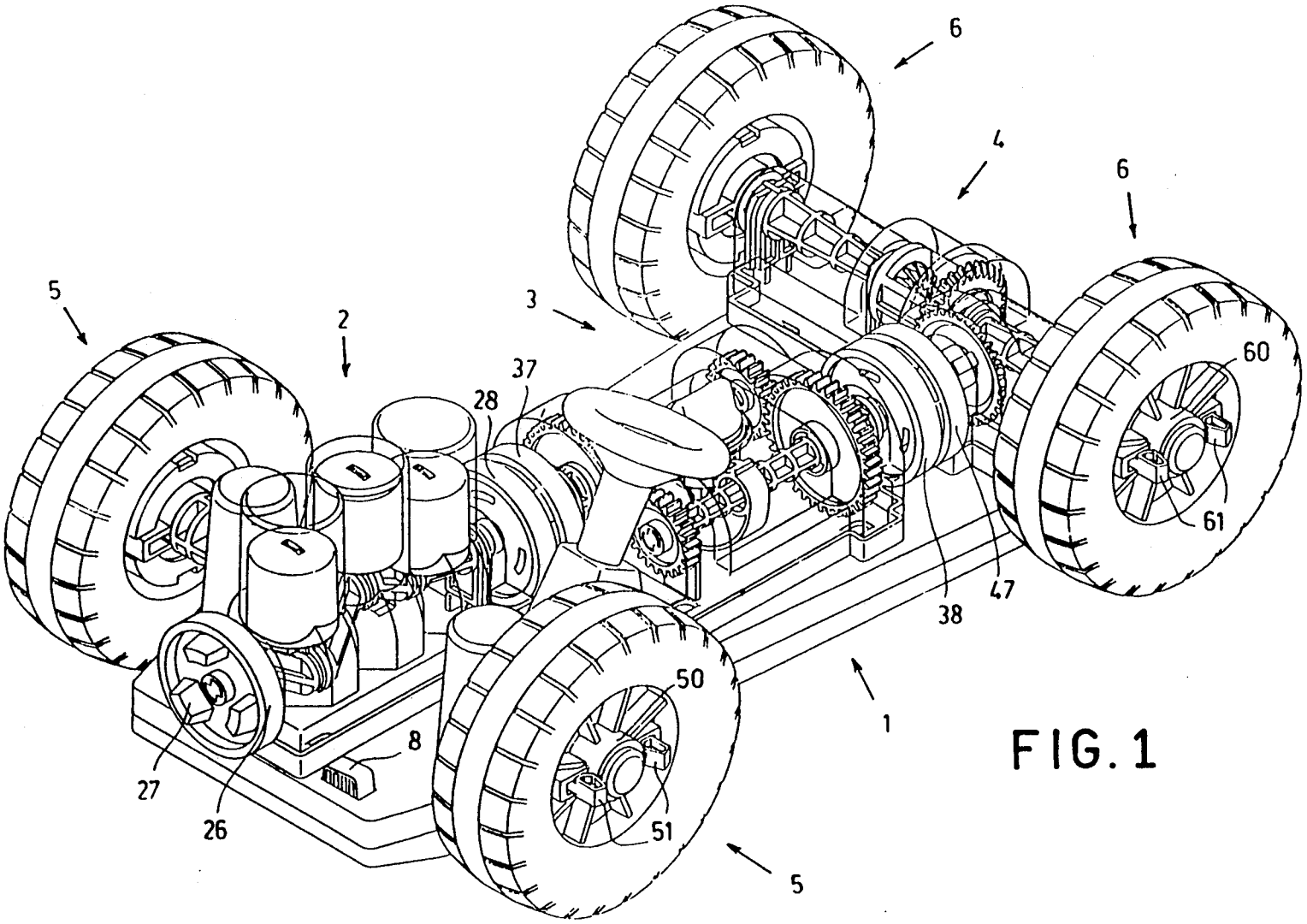
FIG. 1 shows in an isometric perspective an embodiment of the vehicle model according to the invention, in its whole.

With reference at first to FIG. 1, it is to be noted that the vehicle model comprises: a supporting unit, which simulates the frame of a real vehicle and therefore will be designated in the following as the frame unit, which is denoted in its whole by numeral 1 and which, in this case, also comprises the steering gear and the stub axles for mounting the steering front wheels 5; an engine unit, denoted in its whole by numeral 2, which simulates the internal combustion engine of a real vehicle, and which is dismountably applied to the frame unit 1; a transmission unit, denoted in its whole by numeral 3, which simulates the transmission of a real vehicle, and which is dismountably applied to the frame unit 1 and is operatively connected to the engine unit 2; and a differential unit, denoted in its whole by numeral 4, which is dismountably applied to the frame unit 1, is operatively connected to the transmission unit 3 and is provided with two axle shafts for mounting the rear wheels 6, which simulate the driving wheels of a real vehicle.

Figure 2:
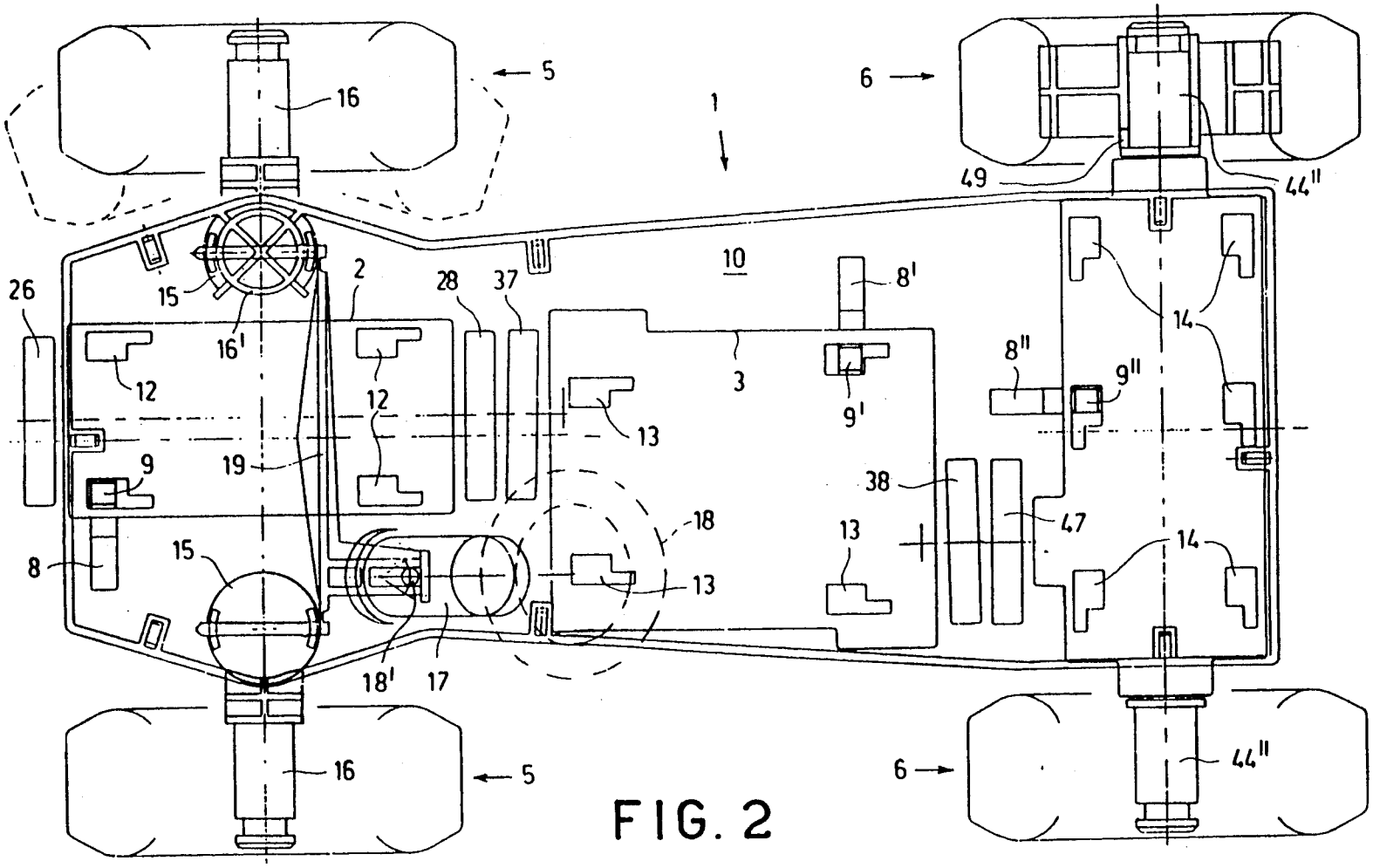
FIG. 2 is a plan view of the supporting structure of the model, which simulates the frame of a real vehicle, with indication of the outline of various operative units intended to be applied thereto.
Figure 3:
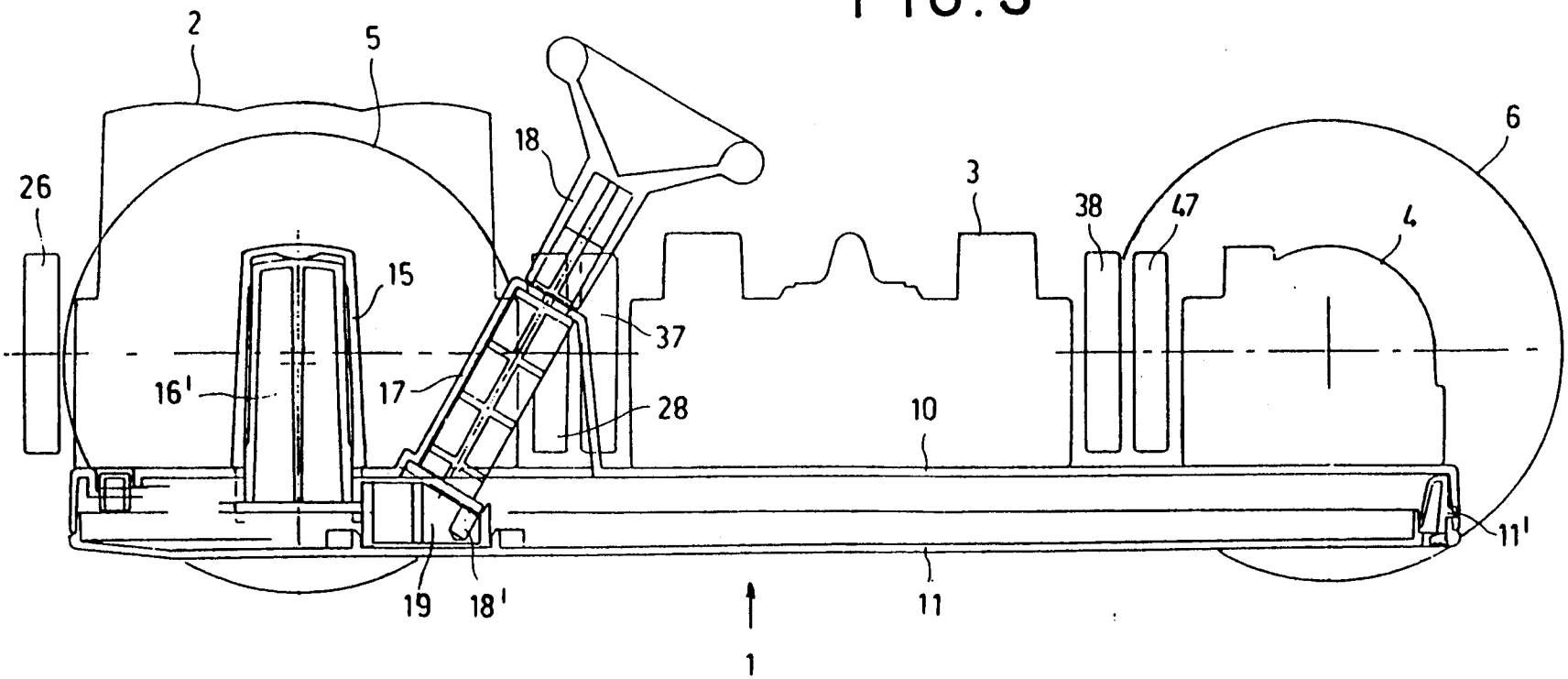
FIG. 3 is a representation similar to that of FIG. 2, but in a side elevation and with some part shown in cross section.

The supporting structure or frame unit 1 is separately shown in more detail in FIGS. 2 and 3. It comprises a box plate formed by a top plate 10 and a bottom plate 11, which may be connected together by means of elastic snap members 11', as shown by FIG. 3. The top plate 10 shows suitable places for receiving the engine unit 2, the speed gear unit 3 and the differential unit 4, which are shown in these figures only by their outline. The top plate 10 has bayonet openings, respectively 12, 13 and 14, for hooking said units, whose mounting will be explained later on. Moreover the frame unit 1 has vertical bearings 15 wherein there are housed the orientation trunnions of the stub axles 16, foreseen for mounting the steering front wheels 5, whose fixation to the stub axles will be described later on. The frame unit 1 also has an inclined supporting member 17 for a steering control 18, which is coupled by means of an excentric 18' to a cross bar 19 hinged to the stub axles 16, whereby the maneouvre of the steering control 18 allows orienting within certain limits (shown by dash lines in FIG. 2) the stub axles 16 and therefore the steering front wheels 5.

Figures 4, 5, 6, 7:
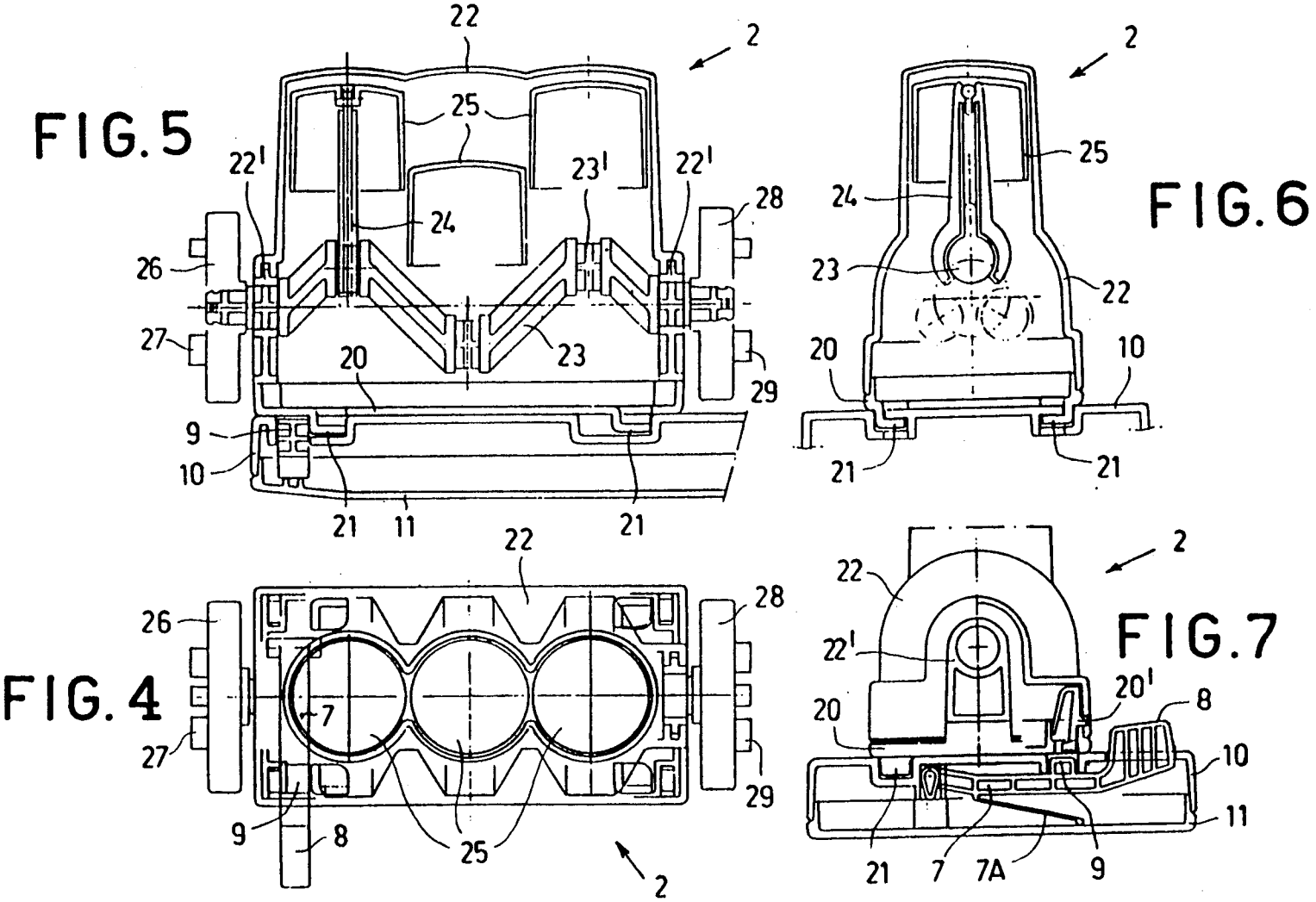
FIGS. 4, 5 and 6 show, respectively in plan view, in a side elevation and in a vertical cross section, the unit which simulates the internal combustion engine of a real vehicle.
FIG. 7 shows the means for fixing the engine unit onto the supporting structure.

The engine unit, separately shown in more detail in FIGS. 4 to 7, comprises a base plate 20 on which there is mounted a casing 22 which simulates the cylinder-block and the head of an internal combustion engine. Casing 22 is made of a transparent material in order to allow observing the structure, the relationship and the movements of the internal parts. The connection between base plate 20 and casing 22 may be effected by means of elastic snap members 20' as shown by FIG. 7. Base 20 has bayonet couplings 21 suitable for engaging the bayonet openings 12 of the frame unit 1. The engine unit 2 may be mounted onto the frame unit 1 by engaging the bayonet couplings 21 into the openings 12 and then sliding the engine unit 2 rearwards. The mounting position may then be stabilized by means of the arrangement shown in FIG. 7. A lever 7 is pivoted in frame unit 1 and carries at one end thereof a push-button 8, which allows lowering lever 7 against the action of an elastic appendix 7A of the lever. Moreover, lever 7 has a tooth 9 suitable for engaging the larger portion of a bayonet opening 12. By this arrangement, tooth 9 carried by lever 7 retracts elastically when the engine unit 2 is inserted with its bayonet couplings 21 into the openings 12 of frame unit 1. After the engine unit has been displaced rearwards in its definite position, tooth 9 is returned elastically onwards by the force exerted by the elastic appendix 7A, and then it prevents a displacement in forward direction of the engine unit 2. Therefore this unit cannot get detached by accident from the frame unit 1. However it is always possible to intentionally dismount the engine unit 2. This is done by lowering push-button 8, which on its turn lowers tooth 9 thus allowing the engine unit to be displaced in forward direction in order to disengage the bayonet couplings 21 fron openings 12.

The transparent casing 22 has journal bearings 22' in which there is pivoted a crank shaft 23 provided with crankpins 23'. On each crankpin 23' there is pivoted a connecting rod 24, on its turn hinged to a piston 25 which is slidably mounted in a partially cylindrical guide portion of casing 22. On the front end of crank shaft 23 there is mounted a fly-wheel 26 provided with a teeth coupling 27; these parts may be better observed in FIG. 1. In a similar manner, on the rear end portion of crank shaft 23 there is mounted a fly-wheel 28 provided with a teeth coupling 29, intended to establish the operative connection of engine unit 2 with the transmission unit 3.

Figure 10:
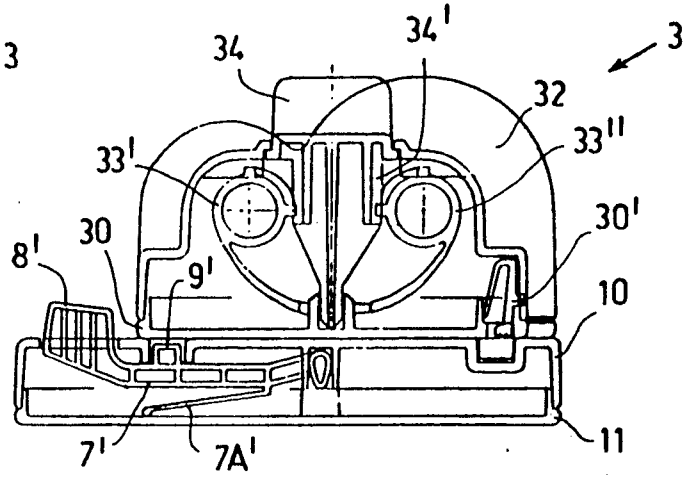
FIG. 10 shows the means for fixing the speed gear unit onto the supporting structure.
Figure 9:
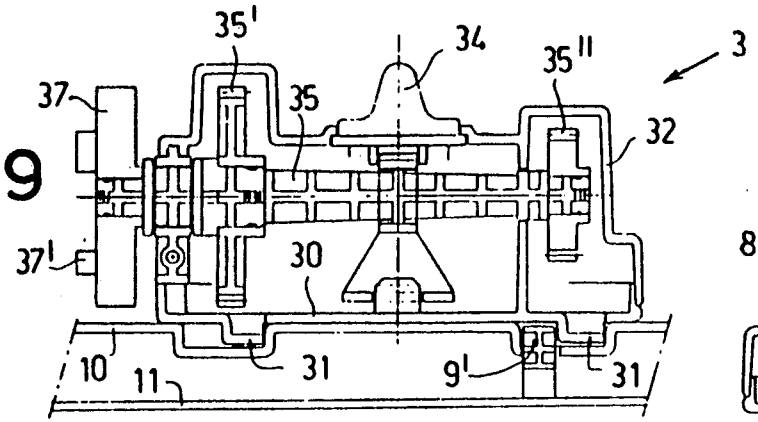
FIGS. 8 and 9 show, respectively in plan view and in a side elevation, the unit which simulates the transmission of a real vehicle.
Figure 8:
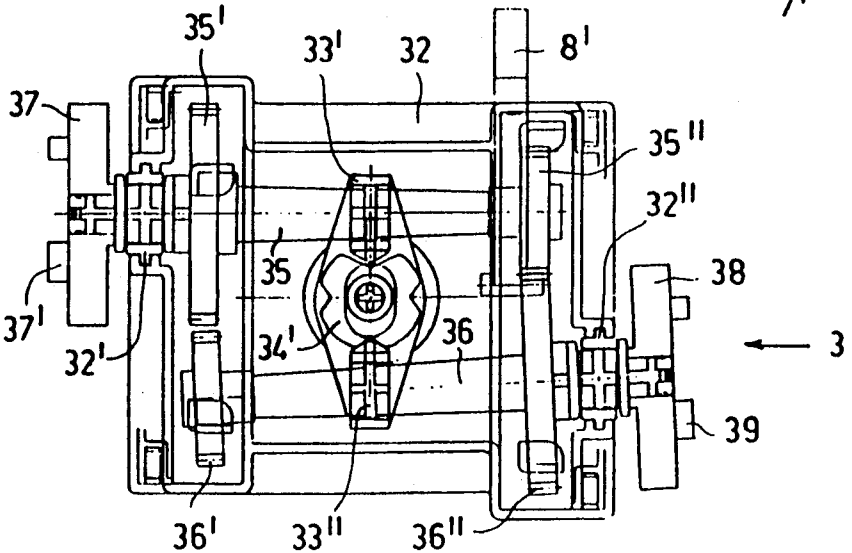

The transmission unit 3, separately shown in more detail in FIGS. 8 to 10, comprises a base plate 30 on which there is mounted a casing 32 which simulates the gear box of a motor vehicle. Casing 32 is made of a transparent material in order to allow observation of the structure, relationship and movements of the inner parts. The connection between base plate 30 and casing 32 may be effected by means of elastic snap members 30', as shown by FIG. 10. Base plate 30 has bayonet couplings 31 suitable for engaging the bayonet openings 13 of the frame unit 1. The transmission unit 3 may be mounted onto the frame unit 1 by engaging the bayonet couplings 31 in the openings 13 and then sliding the speed gear unit 3 rearwards. The mounting position may then be stabilized by means of the arrangement shown in FIG. 10, which comprises a lever 7' having an elastic appendix 7A', a push-button 8' and a tooth 9'. This arrangement 7'-9' is completely similar, both structurally and operationally, to the arrangement 7-9 described in connection with the engine unit 2 with reference to FIG. 7, and therefore it will not be further discussed.

The transparent case 32 comprises two fixed bearings 32' and 32'', and inside the casing are mounted two swinging bearings 33' and 33'' which may be displaced in horizontal direction by means of a cam 34', solid with a control knob 34 located outside casing 32, which knob may be manoeuvered by rotating it. In bearings 32' and 33' there is pivoted a driving shaft 35 which carries two toothed wheels 35' and 35'' and, at its front end, a fly-wheel 37 provided with a teeth coupling 37' complementary to the teeth coupling 29 of the fly-wheel 28 of engine unit 2. In bearings 32'' and 33'' there is pivoted a driven shaft 36 which carries two toothed wheels 36' and 36'', located in front the respective toothed wheels 35' and 35'' of driving shaft 35. On the rear end of driven shaft 36 there is mounted a fly-wheel 38 provided with a teeth coupling 39.

According to the position imposed to the bearings 33' and 33'' by cam 34', whose position is controlled by means of knob 34, the shafts 35 and 36 may assume different relative positions in a horizontal plane. In the position shown in FIG. 8, shaft 35 is parallel to the longitudinal axis of casing 32, whereas shaft 36 is inclined; the toothed wheels 35'' and 36'' are mutually meshing, whereas toothed wheels 35' and 36' are at a certain mutual distance and do not mesh. The gear ratio between shafts 35 and 36 depends on the pitch diameters of toothed wheels 35'' and 36'', which ratio in this case is in multiplication. If knob 34 and 34' are rotated by 180°, the positions of shafts 35 and 36 are inverted, namely, shaft 36 becomes parallel to the longitudinal axis of casing 32 and shaft 35 now becomes inclined. As a consequence, toothed wheels 35' and 36' are meshing, whereas toothed wheels 35'' and 36'' do no more mesh, and the gear ratio between shafts 35 and 36 now depends on the pitch diameters of toothed wheels 35' and 36', which ratio in this case is in demultiplication. Finally, in the two possible positions of knob 34 and cam 34', rotated by 90° in the one or the other direction with respect to the position shown in FIG. 8, both shafts 35 and 36 are inclined with respect to the longitudinal axis of casing 32, and neither the toothed wheels 35'-36' nor the toothed wheels 35''-36'' are meshing. Thus there is obtained a condition of idle gear and there is no transmission between shafts 35 and 36. Therefore, the speed gear unit 3 forms a device which modifies the transmission ratio between fly-wheels 37 and 38, with two different transmission ratios and an idle condition.

The differential unit 4, separately shown with more detail in FIGS. 11 to 14, comprises a base plate 40 on which there is mounted a casing 42 which simulates the rear train of a motor vehicle. Casing 42 is made of a transparent material in order to allow observing the structure, relationship and movements of the inner parts. The connection between base 40 and casing 42 may be effected by means of elastic snap members 40', as shown by FIG. 14. Base 40 has bayonet couplings 41 suitable for engaging the bayonet openings 14 of the frame unit 1. The differential unit 4 may be mounted onto the frame unit 1 by engaging the couplings 41 in openings 14 and then sliding the differential unit 4 laterally (namely towards the bottom according to FIG. 2). The mounting position may then be stabilized by means of the arrangement shown in FIG. 14, which comprises a lever 7" with an elastic appendix 74", a push-button 8" and a tooth 9". This arrangement is completely similar, both structurally and operatively, to the arrangement 7-9 described with respect to the engine unit 2 with reference to FIG. 7, and therefore it will not be further discussed.

Casing 42 keeps in correct position some members 43 forming bearings located as shown by FIGS. 11 and 12. In two coaxial pairs of these bearings there are pivoted two coaxial axle shafts 44, each having at its inner end a conical toothed wheel 44' and at its outer end an axle 44" for mounting one of the rear wheels 6 (shown, along with the differential unit, in FIG. 11). With both conical toothed wheels 44', which are mutually facing, meshes a conical toothed wheel 45' whose axis is perpendicular with respect to the common axis of the conical toothed wheels 44' and is rotatably supported by a cage 45. Cage 45 is rotatably mounted onto the inner end portions of both coaxial axle shafts 44, and it carries an outer conical crown wheel 45". The just described mechanism 44-45 forms a mechanical differential between the driving outer crown wheel 45" and the axle shafts 44, which are driven by said crown wheel in a differential manner. The conical crown wheel 45" meshes on its turn with a conical toothed wheel 46', carried at the inner end by a shaft 46 which is mounted in a pair of coaxial bearings 43 of casing 42. On the outer end of shaft 46 there is mounted a fly-wheel 47 provided with a teeth coupling 48, complementary to the teeth coupling 39 of the rear fly-wheel 38 of transmission unit 3. It may be remarked that all the described fly-wheels 26, 28, 37, 38 and 47 may be identical the one another from the constructive point of view.

Each rear wheel 6 comprises a hub 60, by means of which it may be mounted on the axle 44" of one of the axle shafts 44 of differential unit 4, and it is so shaped that, when mounted, it engages a tooth 49 of axle shaft 44, whereby it is then solid in rotation with respect to the mounting axle shaft. Moreover, in each wheel there is provided at least one elastic catch 61 (FIG. 11), and practically there are preferably provided two such catches, diametrically opposite (FIG. 1). Catch 61 is suitable for elastically snapping in a groove of the corresponding axle 44", in order to keep the wheel in its correct mounting position. However, catch 61 allows dismounting the wheel, and this is done by pulling outwards the catches 61 and then sliding the wheel out of the supporting axle shaft.

In a similar manner, each front wheel 5 comprises a hub 50, by means of which it may be mounted on the stub axle 16 of the frame unit 1. The stub axle 16 is not provided with a tooth similar to tooth 49 of axle shaft 44, whereby the front wheel 5 remains freely rotatable on the supporting stub axle 16. At least one catch 51 keeps in correct position wheel 5 on the corresponding stub axle, without preventing its rotation, and allows dismounting the same. This arrangement is identical to the arrangement 60-61 described with respect to the rear wheels 6 and it will not be further discussed; it may be seen only in FIG. 1. It is to be remarked that the front and rear wheels may be identical to one another from the constructive point of view.

When the vehicle model is disassembled in its described component units, each of these latter may be singularly examined in its structure, revealed by the corresponding transparent casing, and, by rotating one of the fly-wheels with which each unit is provided, one may examine in detail the operative relationship among the inner component parts. In particular, from the engine unit 2 one may deduce the relationship between the rotary movement of the crank shaft 23 and the reciprocating movements of connecting rods 24 and pistons 25. From the transmission unit 3 one may deduce how is established or interrupted the transmission of movement, and how the corresponding transmission ratio is modified. From the observation of the differential unit 4 may be clarified the operation, per se complicated and not easy to be realized, of a mechanical differential.

It is to be remarked that dismounting the different units is effected, in the preferred embodiment shown, by rendering free each unit through a pressure of a push-button which is accessible from above, and by simultaneously sliding the unit in a preestablished direction. The use of a push-button which may be actuated from above, as a member for rendering free the unit, considerably facilitates this operation.

It is also to be noted that, with the stated arrangement, the presence of each unit prevents dismounting the units located lying behind the same. Therefore, dismounting the different units is possible only by starting from the engine unit and then proceeding each time with the unit lying behind, whereas an inverted order should be respected in composing again the model. This obligation is useful and formative in that it accustoms the user to follow a logical preestablished order in effecting the operations.

The operation of mounting the different operative units on the frame unit is per se an attractive and formative activity. When it has been effected by disposing the various units in the preestablished order and manner and by fixing the same in their positions, having care of operatively engaging the teeth couplings 29 of the engine unit and 37' of the transmission unit, as well as the teeth couplings 39 of the speed gear unit and 48 of the differential unit, it becomes possible to observe in their whole the operative relationship of all mechanisms, from the engine up to the vehicle wheels, in the different positions of the speed gear. This observation does not require, per se, any manual ability, and therefore it is suitable also for very young people, who are not yet capable of effecting the operations for dismounting and mounting again the operative units, operations which are reserved for users of more advanced age.

Moreover, as already stated, the different constituting units are mounted, on their turn, by means of elastic snap members such as 11', 20', 30', 40'. Therefore, by disengaging these members it is possible to dismount each constituting unit in the single elements which assemble the same, and then mounting again the unit. Of course, such operation is more difficult than those concerning the disassembly and assembly of the model, described above. Such operation may be confronted only by people of a considerably mature age; it extends to such people, by increasing for the same, the attractiveness of the toy.

Of course, various modifications may be made to the embodiment which has been described and shown as an example, without any modification to the main idea of the invention. For example, the described model, which concerns a motor car having front engine, rear driving wheels and front steering wheels, may be modified with respect to a rear mounting of the engine, to a front position of the driving wheels, to an integral four wheels driving or even to four steering wheels, as provided in some special vehicles. The engine unit, shown by example as having three cylinders in line, may have any number of cylinders, located in line in a vertical or a horizontal plane, or may be a V-engine or a radial engine. The speed gear unit may have more than two gear ratios, and the different transmission ratios could be obtained in a manner different from that stated, possibly more similar to the reality, and by means of couplings which may be either radial or frontal. The differential unit could be provided with mechanisms for blocking its operation, as they are foreseen in offroad vehicles. The rear train could comprise two axles and/or twin wheels as used in trucks. The steering unit, which in the embodiment shown is solid with the frame unit, could be embodied as a separate operative unit. The operative coupling among the different units could be effected in a manner different from fly-wheels having teeth couplings. Even the mounting and the dismountable fixing of the operative units onto the frame unit could be effected in a manner different from that described.

I claim:

1. An instructive toy consisting in a disassemblable vehicle model, comprising: a frame unit which substantially simulates the frame of a real vehicle, said frame unit forming a supporting structure and having releasable connection means; and a plurality of operative units which substantially simulate main functional units of a real vehicle, each said operative unit having releasable connection means complementary to said releasable connection means of said frame unit, and each said operative unit also having operative connection means, said operative connection means of each said operative unit being complementary to the operative connection means of another operative unit, and each operative unit comprising a transparent casing and movable component parts intended to simulate operation of a simulated real functional unit of a real vehicle, said movable component parts of each operative unit being mounted within said transparent casing of the operative unit, each said operative unit comprising a base having said connection means complementary to said releasable connection means of said frame unit, said transparent casing being mounted on said base, and said component parts being mounted on said base within said transparent casing, each said operative unit comprising elastic snap members, which allow disassembling said operative unit into its component parts, and assembling it again.

2. An instructive toy consisting in a disassemblable vehicle model, comprising: a frame unit which substantially simulates the frame of a real vehicle, said frame unit forming a supporting structure and having releasable connection means; and a plurality of operative units which substantially simulate main functional units of a real vehicle, each said operative unit having releasable connection means complementary to said releasable connection means of said frame unit, and each said operative unit also having operative connection means, said operative connection means of each said operative unit being complementary to the operative connection means of another operative unit, and each operative unit comprising a transparent casing and movable component parts intended to simulate operation of a simulated real functional unit of a real vehicle, said movable component parts of each operative unit being mounted within said transparent casing of the operative unit, said releasable connection means of said frame unit and of said operative units comprising bayonet openings formed in one of said frame unit and said operative units and bayonet couplings formed on the other of said frame and said operative units, at least one of said releasable connection means further including a retainment tooth intended for elastically snapping in an engaged position into one of said bayonet openings when an operative unit is mounted on said frame unit, and a control member operatively connected to said retainment tooth for displacing said retainment tooth in a disengaged position, in order to allow extracting said bayonet couplings from said bayonet openings and dismounting said operative unit from said frame unit.

3. An instructive toy as set forth in claim 2, wherein said operative units mainly comprise an engine unit, which simulates an internal combustion engine of a real vehicle, a transmission unit, which simulates a transmission of a real vehicle, and a differential unit, which simulates a mechanical differential and a rear axle of a real vehicle.

4. An instructive toy as set forth in claim 2, wherein said releasable connection means further comprises an oscillating lever operatively connected to said retainment tooth and said control member, said oscillating lever having an elastic appendix arranged to return said oscillating lever towards a position corresponding to the engaged position of said retainment tooth, and said control member having the shape of a push-button arranged for being operated from above the frame unit.

5. An instructive toy as set forth in claim 2, wherein said operative units are so arranged that each operative unit prevents dismounting at least one other operative unit, whereby the operations for dismounting and mounting again the different operative units may be effected only according to a preestablished order.

6. An instructive toy as set forth in claim 2, wherein said operative connection means of said operative units comprise fly-wheels and teeth couplings.

7. An instructive toy as set forth in claim 2, wherein said frame unit includes stub axles intended for receiving steering wheels, and a steering mechanism.

8. An instructive toy as set forth in claim 3, wherein said transparent casing of the engine unit comprises journal bearings and partially cylindrical guide means, and the engine unit comprises a crank shaft pivoted in said journal bearings and having crankpins, a number of connection rods pivoted onto said crankpins, and pistons linked to said connecting rods and guided by said partially cylindrical guide means of the transparent casing.

9. An instructive toy as set forth in claim 3, wherein said transparent casing of said speed gear unit comprises fixed bearings, and said speed gear unit comprises movable bearings located inside said casing, a driving shaft and a driven shaft, both mounted in said fixed and movable bearings, toothed wheels mounted on said driving and driven shafts and suitable for mutually meshing, and means for displacing said movable bearings in order to realize for said toothed wheels different meshing conditions and possibly a non-meshing condition.

10. An instructive toy as set forth in claim 9, wherein said means for displacing the movable bearings comprise a cam and a control knob which may be actuated from outside said transparent casing of the speed gear unit.

11. An instructive toy as set forth in claim 3, wherein said differential unit comprises: two axle shafts pivoted in said transparent casing, each axle shaft having at its outer end an axle intended for receiving a wheel and having at its inner end a conical toothed wheel; a cage having an outer conical crown wheel, an orthogonal conical toothed wheel rotatably carried by said cage and suitable for meshing with said conical toothed wheels of the axle shafts, and a driving conical toothed wheel which meshes with said conical crown wheel.

12. An instructive toy as set forth in claim 2, which comprises a number of axles and wheels, each wheel having a hub for mounting on an axle and having an elastic catch arranged for keeping the wheel on the axle though allowing intentionally dismounting the wheel.

* * * * *